US012473069B2

(12) United States Patent
Berton

(10) Patent No.: US 12,473,069 B2
(45) **Date of Patent: *Nov. 18, 2025**

(54) SYSTEM FOR PROVIDING THRUSTER EFFECT ON A VESSEL

(71) Applicant: The Yacht Group, LLC, Coral Gables, FL (US)

(72) Inventor: Gerald Berton, Coral Gables, FL (US)

(73) Assignee: THE YACHT GROUP LLC, Coral Gables, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/984,500

(22) Filed: Dec. 17, 2024

(65) Prior Publication Data

US 2025/0121924 A1 Apr. 17, 2025

Related U.S. Application Data

(63) Continuation of application No. 18/611,169, filed on Mar. 20, 2024, now Pat. No. 12,168,503.

(60) Provisional application No. 63/453,350, filed on Mar. 20, 2023.

(51) Int. Cl.
*B63H 21/21* (2006.01)

(52) U.S. Cl.
CPC ..... *B63H 21/213* (2013.01); *B63H 2021/216* (2013.01)

(58) Field of Classification Search
CPC ..... B63H 21/213; B63H 2021/216
See application file for complete search history.

(56) References Cited

U.S. PATENT DOCUMENTS

| | | | | |
|---|---|---|---|---|
| 6,142,841 | A | 11/2000 | Alexander, Jr. et al. | |
| 6,234,853 | B1 | 5/2001 | Lanyi et al. | |
| 6,511,354 | B1 | 1/2003 | Gonring et al. | |
| 6,675,733 | B2 * | 1/2004 | Hoshina | B63H 25/02 114/144 RE |
| 6,757,606 | B1 | 6/2004 | Gonring | |
| 7,104,212 | B2 | 9/2006 | Brianza | |
| 7,237,501 | B2 * | 7/2007 | Stallings | B63H 25/04 114/144 R |
| 8,807,058 | B1 | 8/2014 | Roche, IV et al. | |
| 9,132,903 | B1 * | 9/2015 | Gable | B63J 99/00 |
| 10,331,137 | B2 * | 6/2019 | Miller | B63H 5/08 |
| 10,782,690 | B1 * | 9/2020 | Miller | B63H 25/38 |
| 10,913,524 | B1 * | 2/2021 | Wald | B63H 20/12 |
| 11,370,519 | B2 * | 6/2022 | Pettersson | B63J 99/00 |
| 11,383,815 | B1 * | 7/2022 | Miller | B63H 25/02 |
| 11,433,983 | B1 | 9/2022 | Gable et al. | |
| 2003/0191562 | A1 * | 10/2003 | Robertson | B63H 25/42 701/469 |
| 2014/0202368 | A1 | 7/2014 | Morvillo | |
| 2016/0144941 | A1 | 5/2016 | Morvillo | |
| 2023/0049367 | A1 * | 2/2023 | Endrizzi | B63H 25/42 |
| 2023/0259133 | A1 | 8/2023 | Murayama et al. | |
| 2024/0149998 | A1 | 5/2024 | Sakurada | |

* cited by examiner

*Primary Examiner* — Russell Frejd
(74) *Attorney, Agent, or Firm* — The Concept Law Group, PA; Scott D. Smiley; Scott M. Garrett

(57) ABSTRACT

A remote-control unit for control a marine vessel is provided with a thruster actuator and engine actuators. When the marine vessel lacks a thruster, the thruster actuator, when operated, causes the remote-control unit to transmit engine control signals to each of at least two engines to achieve a virtual thruster effect by the marine vessel.

14 Claims, 8 Drawing Sheets

201

200

SYSTEM FOR PROVIDING THRUSTER EFFECT ON A VESSEL

CROSS REFERENCE

This application is a continuation of U.S. patent application Ser. No. 18/611,169, filed Mar. 20, 2024, and issued as U.S. Pat. No. 12,168,503 on Dec. 17, 2024, and through that application claims the benefit of U.S. provisional application No. 63/453,350, filed Mar. 20, 2023, the entirety of which is hereby incorporated by reference.

FIELD OF THE INVENTION

The present invention relates generally to marine vessel operation, and, more particularly, relates to allowing a boat operator to control the boat as if it had total thruster capability when it in fact does not have such thruster capability and to move the entire boat in any azimuth.

BACKGROUND OF THE INVENTION

Thrusters are well known in marine vessels for providing lateral movement of the vessel in low-speed maneuvering. This can greatly assist with docking maneuvers, for example. Some vessels have both bow and stern thrusters, but many of those that are equipped with a thruster have only a bow thruster. In general, thrusters are positioned to create thrust in a port-starboard direction, perpendicular to the thrust of the main engines.

However, many vessels either lack thrusters, and as indicated some have only a bow thruster. In order for such vessels to achieve low speed maneuvering for docking and other operations, some vessel operators will control the main engines to thrust in opposite directions (e.g. one forward and one in reverse) to create a torque on the vessel that moves the bow to port or starboard, as desired. The stern of the vessel can be controlled similarly by running the main engines in opposite directions. However, this requires the operator to carefully control both engines at the same time, adjusting their speed and thrust time, which is quite difficult to accomplish manually.

Therefore, a need exists to overcome the problems with the prior art as discussed above.

SUMMARY

In accordance with some embodiments of the inventive disclosure, there is provided a remote-control unit for operating a marine vessel that includes at least one main engine control, which is an actuator provided on the remote-control unit that is configured to operate each of a port main engine and a starboard main engine of the marine vessel. There can be two such actuators, one for each of the two engines. There is also at least one thruster control, which is an actuator for operating a thruster of the marine vessel. However, the marine vessel being controlled lacks a thruster, at least in the location (bow or stern), to which the actuator corresponds. That is, there can be two thruster actuators, one for a bow thruster and one for a stern thruster. In some cases the marine vessel can have a bow thruster but lack a stern thruster; in such a case the thruster actuator being described here is for the non-existent thruster. Thus, Operation of the at least one main engine control causes the remote-control unit to transmit main engine control signals to control at least one of the port main engine or the starboard main engine in a direction and at a speed relative to an amount of actuation of the at least one main engine control. Operation of the thruster control causes the remote-control unit to transmit main engine control signals to jointly operate both the port main engine and the starboard main engine to achieve a virtual thruster effect on the marine vessel.

In accordance with a further feature, the at least one main engine control is a joystick.

In accordance with a further feature, operation of the thruster control causes the remote-control unit to transmit main control signals to jointly operate both the port main engine and the starboard main engine to achieve the virtual thruster effect on the marine vessel is performed according to a virtual thruster profile stored in the remote-control unit.

In accordance with a further feature, the virtual thruster profile is selected from among at least two virtual thruster profiles stored in the remote-control unit.

In accordance with a further feature, the virtual thruster profile specifies engine direction, engine speed, and a duration parameter for each of the port main engine and the starboard main engine.

In accordance with some embodiments of the inventive disclosure, there is provided a remote-control unit for operating a marine vessel, that includes at least one main engine control actuator that is configured to cause the remote-control unit to transmit engine control signals to control at least one of a port main engine or a starboard main engine in a direction and at a speed relative to an amount of actuation of the at least one main engine control actuator. There is also at least one thruster control actuator that is configured to, when actuated, cause the remote-control unit to transmit main engine control signals to jointly operate both the port main engine and the starboard main engine to achieve a virtual thruster effect on the marine vessel.

In accordance with a further feature, the at least one thruster control actuator is a lever actuator.

In accordance with a further feature, the remote-control unit includes a virtual thruster profile that is stored in the remote-control unit in a non-volatile memory, operation of the at least one thruster control actuator causes the remote-control unit to transmit the main control signals to jointly operate both the port main engine and the starboard main engine to achieve the virtual thruster effect on the marine vessel according to the virtual thruster profile.

In accordance with a further feature, the virtual thruster profile is selected from among at least two virtual thruster profiles stored in the remote-control unit.

In accordance with a further feature, the virtual thruster profile specifies engine direction, engine speed, and a duration parameter for each of the port main engine and the starboard main engine.

In accordance with some embodiments of the inventive disclosure, there is provided a method for operation of a remote-control unit for a marine vessel, the remote-control unit having at least one thruster actuator and at least one main engine actuator. The method includes operating the at least one thruster actuator, and responsive to operating the at least one thruster actuator, the remote-control unit transmitting main engine control signals for each of at least two main engines of the marine vessel to cause a virtual thruster effect by the marine vessel, instead of transmitting thruster control signals.

In accordance with a further feature, transmitting main engine control signals is performed according to a virtual thruster profile stored in the remote-control unit.

In accordance with a further feature, the method further includes selecting the virtual thruster profile from a plurality of virtual thruster profiles that are stored in the remote-control unit.

In accordance with a further feature, the method further includes operating the at least one main engine actuator, and responsive to operating the at least one main engine actuator the remote-control unit transmitting main engine control signals to for at least one of the at least two main engines.

Although the invention is illustrated and described herein as embodied in a system for providing thruster effect in a vessel lacking thrusters, using a thruster control, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. To the extent that the inventive disclosure relies on or uses software or computer implemented embodiments, the terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
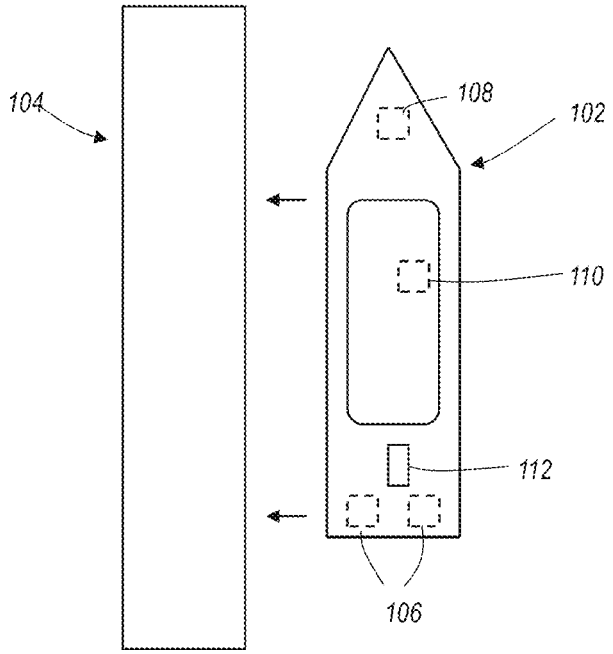
FIG. 1 shows a vessel having a bow thruster in a docking maneuver and using the main engines for additional thruster equivalent action, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 is a diagram showing a marine vessel (yacht) 102 being docked using a remote-control 112, which is capable of operating the main engines of the vessel to simulate a thruster action, in accordance with some embodiments. As used herein, the term "vessel" is interchangeable with the terms "boat" and "yacht." The vessel 102 is shown adjacent a dock 104, and needs to tie up to the dock 104 in a conventional docking activity. The vessel 102 can have one or more main engines 106, a single thruster such as a bow thruster 108, a stern thruster (not shown), and a helm 110. A more common configuration, however, is for the vessel to have either no thrusters or only the bow thruster 108, and two (or more) engines 106. The helm 110 is a station where controls for the various vessel systems are located, including thruster controls and engine controls. These controls are actuators that the pilot can operate by moving, and the actuators produce a signal in response to being operated that is provided to a control hub. The control hub is connected to each of the vessel systems, and provides control signals to the vessel systems in accordance with the signals received from the actuators at the helm. Examples of actuators can include, for example, a joystick to control thruster operation, and throttle and direction controls for the engines. While the helm 110 is a convenient location to operate the vessel 102 while underway, since it allows control of most, if not all vessel systems, it is not always so ideal when performing low speed maneuvers like docking, where it is beneficial to be at the side of the vessel so as to be able to observe the relation between the vessel and the dock. For those type of operations, it is much more helpful to be on the deck, to be able to see exactly where the vessel is in relation to fixed structure like the dock 104. This is made possible by the use of a remote control, or remote-control unit 112. The remote-control 112 sends signals (e.g. radio signals) to the helm 110, and in particular to the control hub at the helm 110, to operate the vessel systems, including the thrusters 108 and the engines 106. The use of a remote-control 112 in docking is well known. However, the ability to precisely control the engines in a manner that results in a vessel response similar to that of a thruster is extremely difficult to manually accomplish. Thus, the remote-control 112 is provided with one or more operation profiles that precisely control each vessel system needed to accomplish a thruster maneuver. The profiles specify engine direction parameters, engine speed parameters, and duration parameter for each of the engines. The operator simple selects a desired simulated thruster profile, and executes it by pressing a button on the remote-control 112. In response, the remote-control 112 then commences sending signals to the helm 110 to control engine operation and thruster operation (if present) according to the profile. The profiles specify an operating level or output level (e.g. throttle control), direction, and time period. Alternatively, the profile can indicate a direction and output level that is to be sent as long as the operator holds a button on the remote-control 112.

The use of actual thrusters only, as described here for low-speed maneuvering, is considered to be prior art. However, according to a novel, inventive arrangement, in order to simulate bow or stern thrusters, or both, the remote-control 112 transmits control signals to operate the main engines (and one thruster, if present) to simulate the effect of having thrusters, or an additional thruster that is not actually present on the vessel. The remote-control 112 transmits using multiple radio frequency bands and "scrolls" through channels while operating to prevent others from being able to take control of the vessel. Further, the remote-control 112 is able to carry out control of the vessel systems according to any of several profiles that allow for increase over time to more gently move the vessel. For example, rather than simply turning the bow thruster or an engine on at a given proportion (e.g. 15%) or speed (e.g. RPMs), the remote-control 112 can ramp up these systems over a period of time.

Figure 2B:
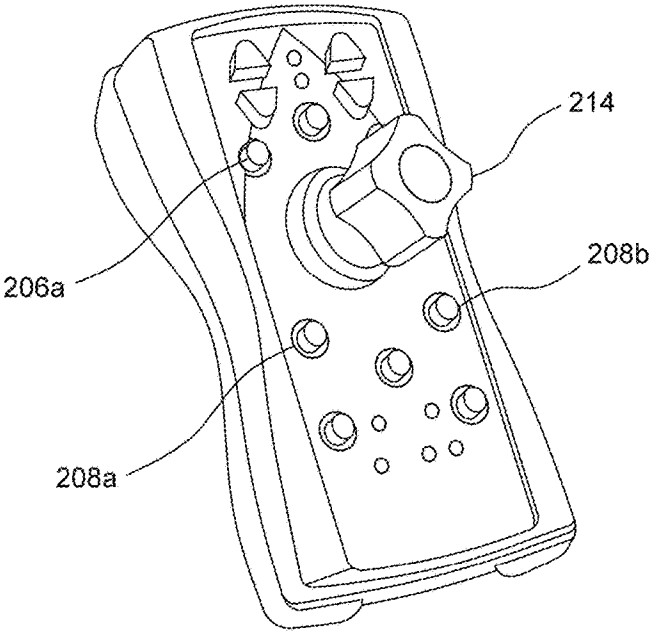
FIGS. 2A and 2B show programmable remote-control units for maneuvering a vessel in which thruster controls can be used to control either actual thrusters on the vessel, or control the main engines to act as a virtual thruster or both if available, in accordance with some embodiments.
Figure 2A:
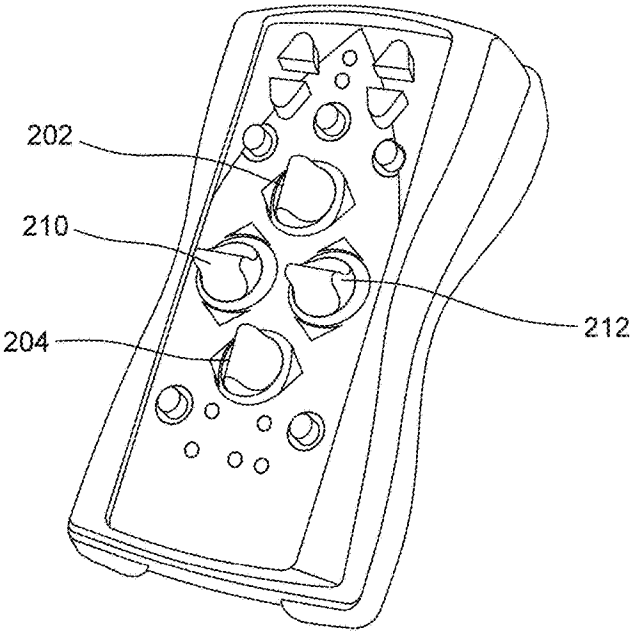

FIGS. 2A and 2B show a pair of remote-control units 200, 201 that can be used with the disclosed invention. The remote-control units 200, 201 both include WiFi transceivers and can store information such as operating profiles. Further, by being WiFi enabled, they can be remotely accessed by authorized parties to perform system diagnostics, update firmware, adjust or change operating profiles, among other operations. The remote-control units 200, 201 can also 'cast' an interface to a portable device or a screen at the helm so that others can see real time parameters, change or adjust profile settings, and so on.

The remote-control units 200, 201 provide both incremental and proportion control of vessel systems. The remote-control units 200, 201 are provided with thruster controls 202, 204 on unit 200, and buttons 206*a*, 208*a*, 208*b* on unit 201. On unit 200, lever actuator 202 can be pushed left or right to achieve bow thrust, or virtual bow thrust, to port or starboard, respectively. Likewise, lever 204 can be pushed right or left to achieve stern thrust, or virtual stern thrust, to port or starboard, respectively. If the vessel has a bow thruster, then lever 202 will control the bow thruster, and similarly if the vessel has a stern thruster, then lever 204 will be configured to control the stern thruster. However, if the vessel lacks a bow thruster, then lever 202 will be configured to concurrently control the two main engines to achieve a virtual bow thruster operation that is meticulously and carefully calibrated to the particular vessel. Likewise, if the vessel lacks a stern thruster, then lever 204 will be configured to concurrently control the two main engines (and bow thruster, if available) to achieve a virtual stern thruster operation.

On unit 201, button 206*a* is configured to control bow thrust to port, and a corresponding button behind the main joystick in this view is configured to control bow thrust to starboard. If the vessel actually has a bow thruster, then these buttons will control operation of the bow thruster. If the vessel lacks a bow thruster, then these buttons will control the main engines to achieve virtual thruster operation. Likewise, buttons 208*a* and 208*b* control a stern thruster, actual or virtual, to port and starboard, respectively. In other words, the same remote-control unit design is configured to either control actual thrusters on the vessel, if the vessel has them, and it can be configured to control the main engines to achieve a very similar effect as if the vessel actually had either an additional thruster or both bow and stern thrusters.

In addition to the thruster controls 202, 204, 206*a*, 208*a*, 208*b*, the remote-control units 200, 201 also include main engine controls. For example, unit 200 includes port main engine control actuator 210 that can be moved forward or backward for forward or reverse direction, and the amount of movement from center is proportional to engine speed. Likewise for starboard main engine actuator 212, which controls operation of the starboard main engine, independent of the port main engine. On unit 201, the joystick 214 is used to control the main engines, to move the vessel forward or rearward, or to provide differential control of the two main engines for engine steering. The joystick 214 can also be programmed to provide thruster or virtual thruster control. By pushing the joystick 214 to the left or right, the thruster operation can be produced, whether using actual thrusters or using the main engines to simulate thruster operation. Thus, the main engine control features are used to independently operate the main engines, and, the thruster controls are configured to jointly control the main engines according to the predetermined profile to achieve a virtual thruster effect. Both engine operation and thruster operation, either actual or virtual, can be conducted simultaneously.

Figure 2C:
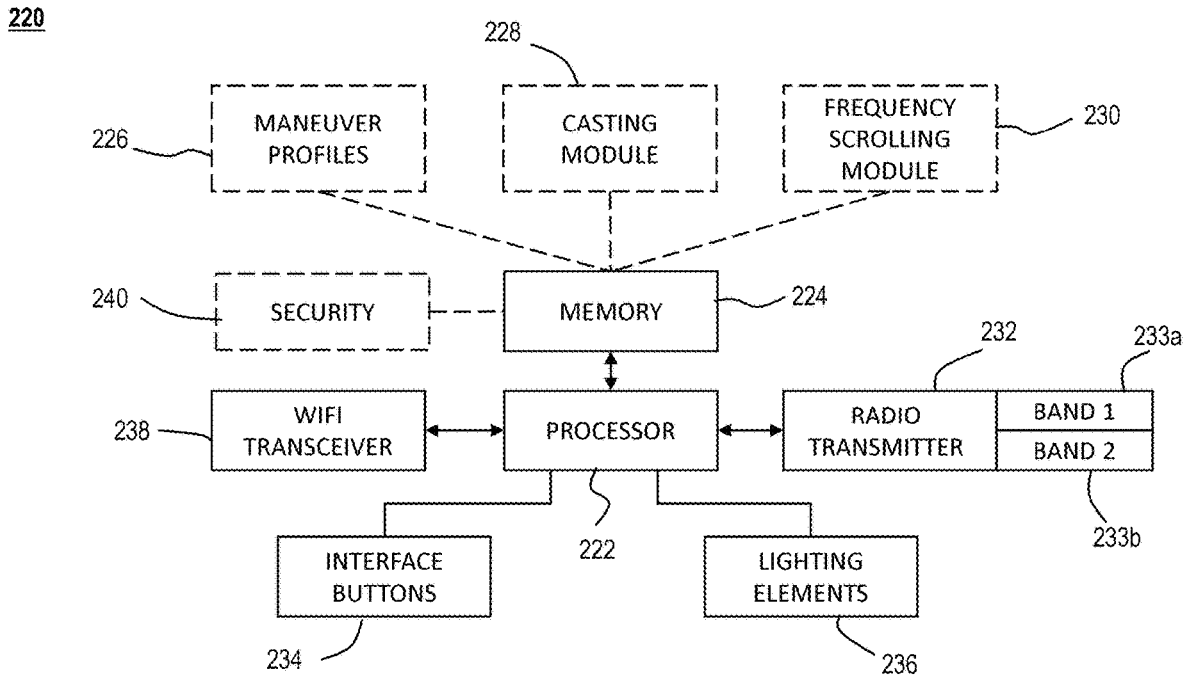
FIG. 2C shows a block diagram of a remote-control unit for controlling a yacht, in accordance with some embodiments.

FIG. 2C shows a block diagram of a remote-control unit 220 for controlling a yacht, in accordance with some embodiments. The remote-control unit can be either of remote-control units 200, 201, or unit 112 of FIG. 1. Each remote-control unit 220 includes a processor 222 that is coupled to memory 224. The memory 224 can include both volatile and non-volatile memory so that data and instruction code can be stored and instantiated, and random access memory (RAM) can be used for data structures as well as executing instruction code. Both a radio transmitter 232 and a WiFi transceiver 238 are included as well. The radio transmitter 232 communicates command and control signals in a secure manner, to a receiver coupled to the control hub of the helm 110, that resists noise by using two 208*a* 233*a*, 233*b* to provide redundancy. That is, the radio transmitter 232 transmits signals on both bands 233*a*, 233*b* at the same time. Each of the bands 233*a*, 233*b* are a separate radio unit having their own mixers, modulators, frequency generators, and other radio circuits. In addition, each spectrum of the bands are divided into several different channels, and the bands 233*a*, 233*b* scroll through those channels during operation in case there is interference on any one of the channels. The channel diversity prevents noise and interference and even attempts to disrupt or capture a channel from interfering with vessel control. In one example, each of the bands 233*a*, 233*b* can define seven channels, which results in forty-nine channel combinations across two different frequency bands. The WiFi transceiver 238 allows the remote-control 220 to be accessed remotely and both send and receive data and other information.

The memory 224 can include, for example, several profiles 226 which specify parameters such as a maximum system speed and a ramp duration time, and the remote-control unit 220 can be operated to select from among those profiles for vessel system operation, based on vessel and environmental conditions. There can be stored in the memory 224 a casting module 228 which allows the remote-control unit 220 to display an interface, via the WiFi transceiver 238, on a helm screen, such as a chart plotter screen. Since the display is a touch screen type display, it can be used to adjust or change profile parameters of one or more of the profiles 226, as well as to perform other operations on the remote-control unit 220. A frequency scrolling module can be used to control the bands 233*a*, 233*b* in their operation to transmit some information, and then change to another channel, transmit some more information, change channel, and so on, continuously. Alternatively, the bands 233*a*, 233*b* can be designed to perform that task themselves.

A security space 240 can contain encrypted security credentials that are used to determine whether someone attempting to access the remote-control unit 220 via the WiFi transceiver 238, for example, is actually authorized to do so. When a user attempt to access the remote-control unit 220, they are prompted for access credentials, such as, for example, a user name and password. If they can provide this information, then they will be allowed to access the remote-control unit 220 and, for example, make changes to the profile(s) 226, update firmware of the remote-control unit 220, and so on.

The remote-control unit 220 also has interface buttons and actuators 234 that each provide into to the remote-control unit 220 and those inputs are assessed by the processor 222. The inputs can include a selection indication, which occurs when the selector button is pushed, as when the operator wants to select and use a specific profile. In addition, the state of the actuator(s) can be assessed to determine what command signals to send to the helm receiver. In the incremental remote-control embodiments, when an engine actuator (e.g. 206) is pushed, the processor causes command signals to be send by the bands 233*a*, 233*b* such that the corresponding vessel system ramps up over a duration specified in the profile to the maximum level specified in the profile, until the user releases the actuator, where the processor will cause the bands 233*a*, 233*b* to send command signals that shut down the output of the corresponding vessel system. In the case of the proportional remote-control unit, then the position of the joystick is converted to a proportion of the maximum operating level of the corresponding vessel systems, and the processor 302 sends command signals accordingly via the radio transmitter 232 and the bands 233*a*, 233*b*. There can also be lighting elements 236 such as light emitting diodes (LEDs) that indicate the state of the remote-control unit 220.

Figure 3:
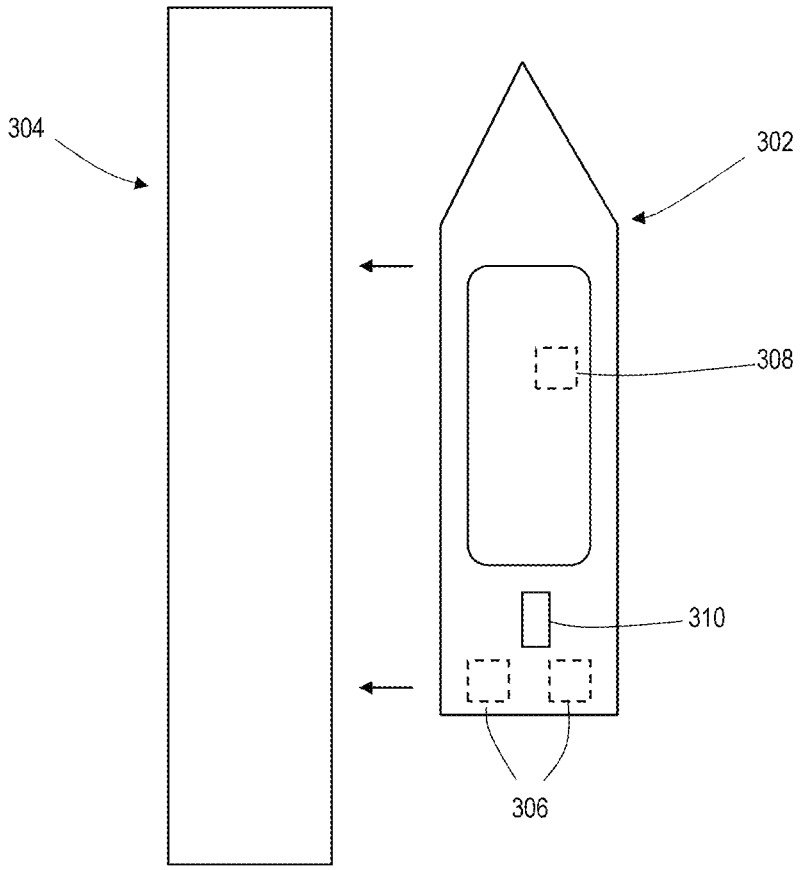
FIG. 3 shows a vessel that does not have a thruster being operated by a remote in virtual thruster control, in accordance with some embodiments.

FIG. 3 shows a vessel 302 that does not have a thruster being operated by a remote-control unit 310 in virtual thruster control to move the vessel 302 towards a dock 304. The remote unit 310 can be one of units 200, 201, 112 and, since vessel 302 lacks thrusters, remote unit 310 transmits main engine control signals to a receiver at helm unit 308, which controls the main engines 306 (speed and direction). To achieve the effect of a thruster, the main engines are controlled to spin their propellers to create thrust in opposite directions, creating a torque on the vessel that causes rotation of the vessel. However, the main engines are not necessarily operating at the same output level. For example, the port engine can operate at 9% reverse and the starboard engine can operate at 5% forward, in one case, to turn the bow to port. In addition, the engine operation can be differently timed. That is one engine can begin operating before or after the other, and the engines can be operated for different durations of time at their respective speed and direction. Once the bow of the vessel 302 is moving the desired direction, then stern thrust can be simulated by operating the engines in the reverse direction (port in forward and starboard in reverse) and the momentum of the bow moving to port will counteract the tendency of the vessel to rotate, and result in the stern of the vessel also moving to port. Because of the difference in weight distribution of the vessel, when simulating a stern thruster, the engines can operate for different times and at different speeds, not just different directions, relative to when simulating bow thruster operation. From the operator's perspective, the vessel 302 is controlled as if it actually has thrusters because the same thruster controls are used on the remote-control unit 310 as would be used to control actual thruster(s), and the resulting movement of the vessel is substantially the same. That is, when the vessel has an actual thruster, then operation the thruster control (e.g., 202, 204, or 206*a*) on the remote-control unit 310 will send thruster control signals to the receiver at the helm unit to operate the actual thruster(s) accordingly. But when the vessel 302 lacks thrusters, then operation of the thruster control on the remote-control unit 310 results in the remote-control unit 310 sending engine control signals to the receiver at the helm unit 308 for each of the engines 306, according to a selected thruster operation profile.

Figure 4A:
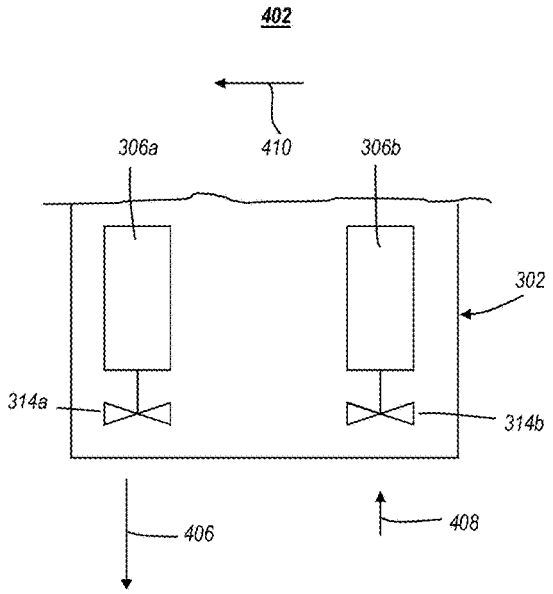
FIGS. 4A and 4B show the stern of a vessel and the main engines being operated under virtual thruster control, in accordance with some embodiments.
Figure 4B:
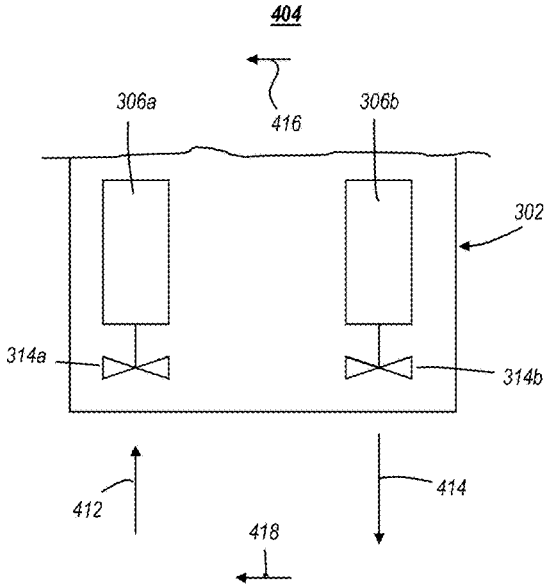

FIGS. 4A and 4B show the stern of a vessel 302 and the main engines 306*a*, 306*b* being operated under virtual thruster control. In scenario 402, to generate movement 410 of the bow to port, port main engine 306*a* is operated to drive propeller 314*a* to generate thrust 406 in a reverse direction and starboard engine 306*b* is operated to drive propeller 314*b* to generate thrust 408 in a forward direction, under control of a remote-control unit when the thruster actuator on the remote-control unit is actuated. Thus, for example, actuator 202 of remote-control unit 200 can be pushed to the left, or button 206*a* on remote-control unit 201 can be pressed. When the thruster actuator of the remote-control unit is actuated, instead of sending thruster control signals to the receiver at the helm, the remote-control unit transmits engine control signal according to a virtual thruster profile.

In scenario 404, once the bow is moving to port, the remote-control unit can be operated to simulate an aft thruster where, instead of the remote-control unit sending aft thruster control signals, the remote-control unit sends engine control signals to the receiver at the helm unit according to a virtual aft thruster profile that results in the engine thrust directions being reversed, compared to scenario 402, so that port engine 306*a* generates thrust 412 in the forward direction, and starboard engine 306*b* is operated in reverse to generate thrust 414. This will somewhat reduce the bow movement 416 but also generate stern movement 418.

While an operator can individually control the port and starboard engines 306*a*, 306*b* to roughly simulate the effect, according to the invention, the operator instead actuates thruster controls on the remote-control unit, which has mapped port and starboard engine control to translate the thruster control input at the remote unit 310 to main engine control signals in order to achieve the desired virtual thruster result. The parameters of the virtual thruster profiles are selected based on testing the specific vessel by trained technicians who determine the parameter values for various virtual thruster profiles. Thus a remote-control unit that has been set up for a given vessel is operable only for that specific vessel, and not other vessels. The virtual thruster profiles can be created for different situations, such as when there is wind in different directions of different magnitude, the distance to the dock, and so on. By provisioning the remote-control unit with such profiles, the operator doesn't have to try to control the main engines to simulate a thruster effect and it is automatically done by the remote-control unit.

Figure 5:
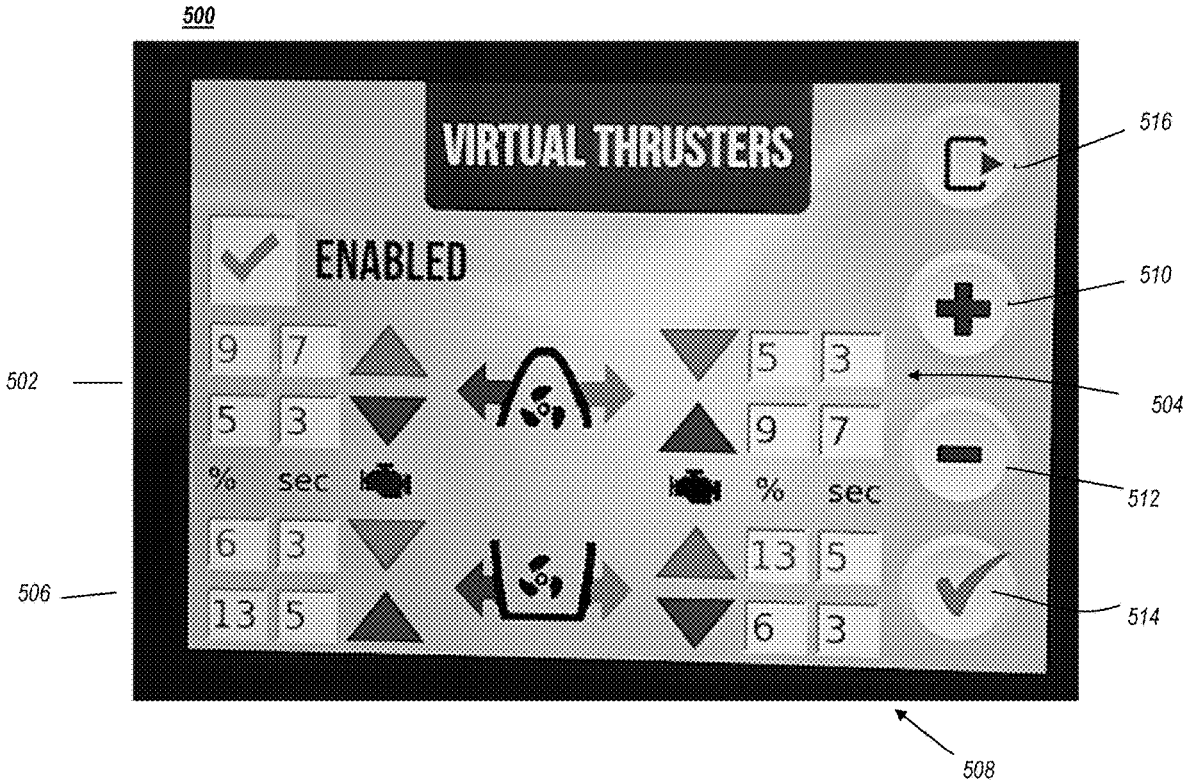
FIG. 5 shows a set up interface for programming a vessel remote-control to simulate thruster operation for a vessel that does not have a thruster, in accordance with some embodiments.

FIG. 5 shows a set up interface 500 for programming a profile into a vessel remote-control unit to simulate thruster operation for a vessel that does not have a thruster. For example, the interface 500 can be displayed on a computing device by a profile authoring application program, and used to set up the resulting main engine operation when an operator actuates the thruster controls 202, 204 or 206*a*, 208*a*, 208*b* of units 200, 201. In the present example, bow thrust to port 502 is achieved by operating the port engine in reverse at 5% for 3 seconds, and the starboard engine is operated at 9% for 7 seconds. These are example numbers only to indicate that the speed and duration are individually controlled for port and starboard engines, based on the particular vessel for which the remote-control unit is being set up. If starboard bow thrust 504 is desired, then the port engine is operated in the forward direction at 9% for seven seconds, and the starboard engine is operated in reverse at 5% speed for 3 seconds. For stern thrust in the port direction 506, the port engine is operated in the forward direction at 13% speed for 5 seconds, and the starboard engine is operated in reverse at 6% speed for 3 seconds. For stern thrust in the starboard direction 508, the starboard engine is operated in the forward direction at 13% speed for 5 seconds, and the port engine is operated in reverse at 6% speed for 3 seconds. The particular values used here are set up by a technician, and will be the result of the combination of factors such as propeller size and design, beam, windage, weight, and other parameters of the vessel. These must be tested for each vessel and then programmed into the remote-control unit to be used in lieu of transmitting thruster control signals when the thruster actuator(s) of the remote-control unit are actuated. The different values and be adjusted with buttons 510, 512, and then set/saved by button 514, and transmitted to the remote-control unit by selecting button 516 via WiFi communication. As an example, the computing device on which interface 500 is displayed can be used to log into the remote-control unit via a WiFi connection, and the remote-control unit can verify access authorization via security module 240, for example. Once connected to the remote-control unit, the interface 500 can be brought up and utilized to set the engine control parameters for the various thruster simulation options. Once the desired parameters are entered, the technician can save the profile and either exit the application program or set up another profile that can be used under different conditions (e.g. vessel conditions such as loading, or environmental conditions such as wind, current, and so on).

A similar interface can be used to set up docking or other low speed maneuvering profiles in which the main engines are operated for docking maneuvers, and also to simulate thruster operation. In such profiles main engine parameters are specified for particular maneuvers in which a thruster would also be used. If the thruster controls are operated at the same time as a docking profile is used, and the thruster control is mapped to control the main engines, rather than an actual thruster, to achieve a virtual thruster effect, then the remote-control unit will sum the profile values of the docking profile and the virtual thruster profile to determine a control value to be output to the main engines. For example, if the docking maneuver requires the port engine to operate forward at 7% speed, but the thruster control is actuated during the maneuver, and the virtual thruster profile requires the port engine to be in reverse at 5%, then the remote-control unit will operate the main port engine to be forward at 2%. On other hand, if the main engine control profile requires the port main engine to operate in forward at 7% and the thruster control operation profile requires the port main engine to operate forward at 5%, then the port main engine can be operated forward at 12%. (7%+5%).

Figure 6:
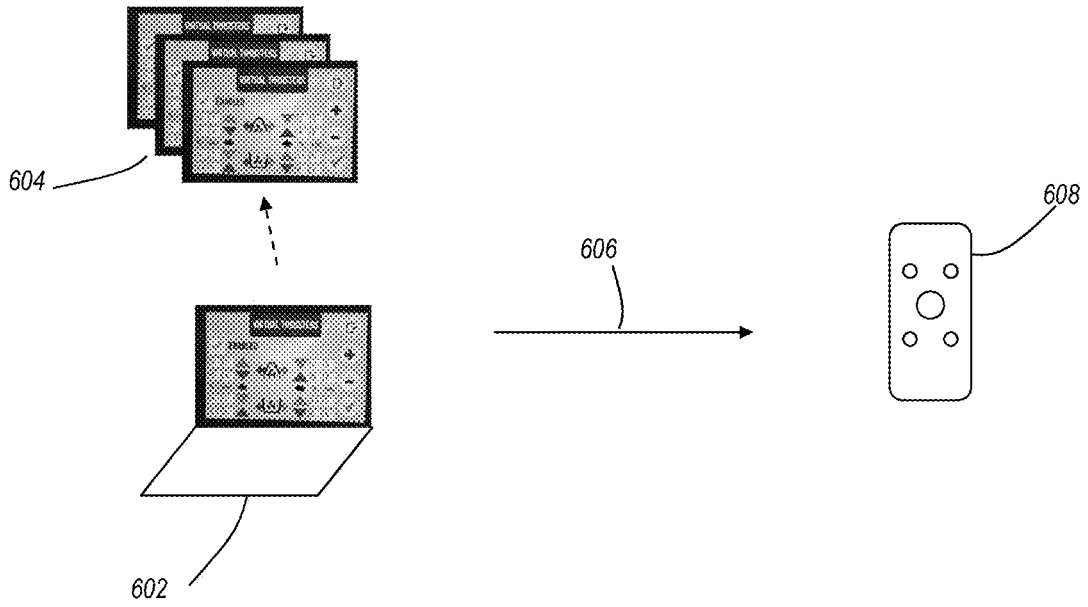
FIG. 6 shows a system for calibrating vessel operation based on the particular parameters of a given vessel in order to achieve optimum virtual thruster operation, in accordance with some embodiments.

FIG. 6 shows a system for calibrating vessel operation based on the particular parameters of a given vessel in order to achieve optimum virtual thruster operation. A technician can use a laptop computer 602 running an application program that accepts input values for control signals that are to be transmitted by a remote-control unit 608 to the helm or equivalent system of a vessel. The computer 602 can present an interface substantially as shown in FIG. 5 to set up virtual thruster operation by, instead of transmitting thruster control signals when the thruster controls on the remote unit 608 are actuated, the remote unit transmits main engine control signals in accordance with the profile (e.g. the direction, engine speed, and duration values) determined for the particular vessel to achieve the desired thruster effect. In some embodiments, there can be several profiles 604 that can be alternatively used by the remote-control unit 608 to account for different conditions of the vessel. For example, if the vessel is loaded versus unloaded, if there are winds that could affect maneuvering, and so on. All of these profiles can be set up and then transmitted 606 to the remote unit 608, allowing the operator to select an appropriate profile for thruster simulation.

Figure 7:
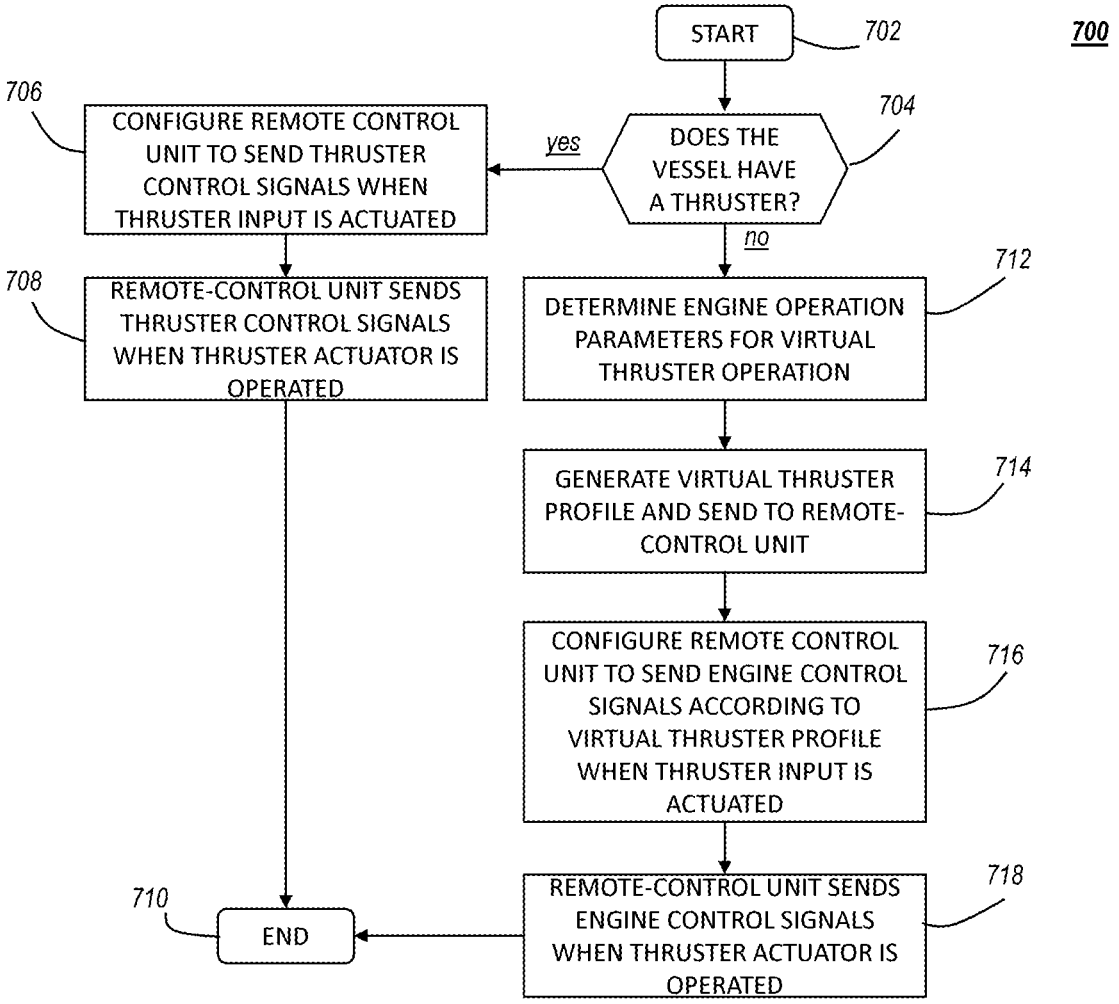
FIG. 7 is a flow chart diagram of a method for configuration a remote-control unit for operating a vessel based on whether the vessel has a thruster, in accordance with some embodiments.

FIG. 7 is a flow chart diagram of a method 700 for configuration a remote-control unit for operating a vessel based on whether the vessel has a thruster, in accordance with some embodiments. At the start 702 it is assumed that a remote-control unit such as those shown in FIGS. 2A-2C is available to be configured for a particular vessel. The remote-control unit has, among other structures, buttons, joysticks, or other input actuators. These include at least one thruster actuator, and at least one actuator to control the engines of the vessel. The remote-control unit can also have input actuators to, for example, select a desired docking profile, and select a desired virtual thruster profile. The method 700 can be applied and repeated for both bow thruster operation and aft/stern thruster operation. That is, for a vessel with a bow thruster but no stern thruster, the remote-control unit can be configured to operate the bow thruster with the bow thruster actuator, and employ virtual thruster operation for the stern thruster actuator where the engines are operated according to a virtual thruster profile.

In step 704 the method 700 branches based on whether the vessel has a thruster, for the thruster location (e.g., bow or stern) being considered. If the vessel does have a thruster, then the method 700 proceeds to step 706 where the remote-control unit is configured to transmit thruster control signals when the corresponding thruster actuator is operated (e.g., pushed, or pressed) by an operator. Thereafter, in step 708, the remote-control unit will send thruster control signals to operate and control the corresponding thruster, and the method 700 ends 710 for that thruster location. However, in step 704, if the vessel lacks a thruster for the location being evaluated, then in step 712 the vessel can be tested to determine the best engine operation parameters (thrust direction, speed, and duration) to simulate the effect of a thruster in the vessel location being evaluated. Then in step 714 a technician can generate a virtual thruster profile and send it to the remote-control unit (e.g., via WiFi). In step 716 the remote-control unit is configured to send engine control signals when the thruster actuator is operated for the thruster actuator corresponding to the vessel location being evaluated. Thus, if the stern location is being evaluated, then the stern thruster actuator is configured to cause the remote-control unit to send engine control signals according to a virtual stern thruster profile. Thereafter, in step 718, the remote-control unit will transmit engine control signal in accordance with the virtual thruster profile when the thruster actuator is operated.

A system for achieving virtual thruster operation, using a remote-control using having thruster controls, for a vessel been disclosed. The disclosed invention provides the benefit of allowing a vessel operator to use a remote-control unit that has thruster controls on it, and to operate those thruster controls to achieve thruster effect. The remote-control unit is configured to, instead of transmitting thruster control signals, to transmit main engine control signals at values that have previously been determined to produce an optimum virtual thruster effect. The virtual thruster effect can be used in place of an actual thruster, or to complement an existing thruster. Thus, even in a vessel with both bow and stern thrusters, the main engines can be operated in addition to the actual thruster(s) to enhance the effect of the thruster(s).

In accordance with the inventive embodiments described herein, there is provided a remote-control unit for operating a marine vessel that includes at least one main engine control that is configured to operate each of a port main engine and a starboard main engine of the marine vessel. The remote-control unit further includes at least one thruster control. The main engine control can be a button or lever, or a joystick where the forward and reverse directions of the joystick control main engine speed and direction. Pushing the joystick directly forward can engage both engines at the same speed, while pushing the joystick forward and to the left can result in the starboard engine operating at a higher speed than the port engine in order to turn the boat to the left/port. Likewise, the control for thruster operation can implemented as buttons, a lever, or the sideways movement of a joystick. Actuation of the at least one main engine control causes the remote-control unit to transmit main engine control signals to control at least one of the port main engine or the starboard main engine in a direction and at a speed relative to an amount of actuation of the at least one main engine control. Actuation of the thruster control causes the remote-control unit to transmit main control signals to jointly operate both the port main engine and the starboard main engine to achieve a virtual thruster effect on the marine vessel.

What is claimed is:

1. A remote-control unit for operating a marine vessel, comprising:

at least one thruster control that is capable of controlling both a thruster as well as each of a port main engine and a starboard main engine;

a radio transmitter;

wherein when the marine vessel includes a thruster, the at least one thruster control is configured to cause the remote-control unit to transmit, via the radio transmitter to a helm unit of the marine vessel, thruster signals to control the thruster;

wherein when the marine vessel does not include a thruster, the at least one thruster control is configured to cause the remote-control unit to transmit, via the radio transmitter, main engine control signals to jointly operate both the port main engine and the starboard main engine to achieve a virtual thruster effect on the marine vessel, according to a thruster profile that is stored in the remote-control unit.

2. The remote-control unit of claim 1, wherein the at least one thruster control is a joystick.

3. The remote-control unit of claim 1, wherein the thruster profile stored in the remote-control unit includes a ramp up time parameter, a direction parameter, an engine speed parameter, and a duration parameter for the port main engine and a ramp up time, a direction, an output level, and a duration for the starboard main engine.

4. The remote-control unit of claim 3, wherein the thruster profile is selected, via an input on the remote control, from among at least two thruster profiles stored in the remote-control unit.

5. The remote-control unit of claim 1, further comprising a WiFi transmitter via which the thruster profile can be edited, and additional thruster profiles can be added to the remote-control unit.

6. The remote-control unit of claim 1, wherein the radio transmitter is configured scroll through a plurality of frequencies when transmitting.

7. The remote-control unit of claim 1, wherein the radio transmitter is configured to transmit across two radio bands.

8. The remote-control unit of claim 1, wherein the at least one thruster control actuator is a lever actuator.

9. A method for operation of a remote-control unit for a marine vessel, the remote-control unit having at least one thruster actuator, responsive to operating the at least one thruster actuator, the remote-control unit transmitting, via a radio transmitter, main engine control signals for each of at least two main engines of the marine vessel to cause a virtual thruster effect by the marine vessel, including transmitting the main engine control signals according to a thruster profile stored in the remote-control unit that specifies a ramp up parameter, a direction parameter, an engine speed parameter, and a duration parameter for each of the at least two main engines.

10. The method of claim 9, wherein the thruster profile stored in the remote-control unit specifies a ramp up parameter, a direction parameter, an engine speed parameter, and a duration parameter for each of the at least two main engines.

11. The method of claim 10, further comprising selecting the virtual thruster profile, via an input on the remote control, from a plurality of virtual thruster profiles that are stored in the remote-control unit.

12. The method of claim 9, further comprising:

operating at least one main engine actuator; and responsive to operating the at least one main engine actuator the remote-control unit transmitting main engine control signals, via the radio transmitter, for at least one of the at least two main engines.

13. The method of claim 9, wherein transmitting the engine control signals via the radio transmitter is performed by transmitting while scrolling through a plurality of radio frequencies.

14. The method of claim 9, wherein transmitting the engine control signals is performed by simultaneously transmitting across two radio bands.

* * * * *